United States Patent [19]

Thompson

[11] Patent Number: 4,873,855

[45] Date of Patent: Oct. 17, 1989

[54] SHOT SENSING SHOT PEENING SYSTEM AND METHOD

[75] Inventor: Robert A. Thompson, New York, N.Y.

[73] Assignee: General Electric Company, Schenectady, N.Y.

[21] Appl. No.: 188,828

[22] Filed: May 2, 1988

[51] Int. Cl.[4] ..... B24C 7/00

[52] U.S. Cl. ..... 72/53; 51/320; 51/415; 73/861.11

[58] Field of Search ..... 72/53; 51/439, 415, 51/438, 320; 73/861.11, 290, 215

[56] References Cited

U.S. PATENT DOCUMENTS

| | | | |
|---|---|---|---|
| 3,636,763 | 1/1972 | Beck | 73/861.04 |
| 4,552,017 | 11/1985 | Biehle | 72/53 |
| 4,614,100 | 9/1986 | Green et al. | 72/53 |
| 4,693,102 | 9/1987 | Amy et al. | 72/53 |

FOREIGN PATENT DOCUMENTS

| | | | |
|---|---|---|---|
| 0228311 | 10/1986 | Japan | 73/861.11 |
| 0260215 | 5/1970 | U.S.S.R. | 73/861.11 |

OTHER PUBLICATIONS

Metals Handbook, Ninth Edition, vol. 5; "Surface Cleaning, Finishing, and Coating", American Society for Metals; Cover Page and pp. 138–149, 9th Ed., vol. 5, Oct. 1982.

Electronics Incorporated, Model 260 Shot Flow Meter Installation Manual and Installation Information, 8-2-0-86.

*Primary Examiner*—David Jones

*Attorney, Agent, or Firm*—John S. Beulick; James C. Davis, Jr.; Paul R. Webb, II

[57] ABSTRACT

A shot peening arrangement uses a magnetic densitometer adjacent the nozzle outlet of a shot peening gun. The magnetic densitometer generates a signal representative of the mass of shot within the coil. The signal is used in combination with the mass flow rate, which may be determined by a conventional shot flow meter, in order to generate a signal representative of the average shot velocity. Additionally, the signal representative of the mass of shot within the coil is supplied to circuitry which detects conditions suggestive of a clog or other malfunction in the system. The circuitry is used to generate an alarm and to turn off power to various components so as to halt the shot peening operation upon improper conditions occurring.

20 Claims, 2 Drawing Sheets

SHOT SENSING SHOT PEENING SYSTEM AND METHOD

BACKGROUND OF THE INVENTION

The present invention relates to shot peening and, more specifically, shot peening wherein the shot is sensed in order to determine a characteristic or quality of the shot peening process.

The use of shot peening is relatively well known. In particular, a stream of shot (i.e., particles) is directed at a surface at high velocity. The shot is directed at the surface on a workpiece so as to cause plastic deformation of the surface of the workpiece, often a metal surface. The shot peening is often used to increase fatigue strength, although the process may be applied for other purposes.

Various shot peening devices and techniques have been developed over the years.

Shot peening systems generally have (or can be readily equipped with) mass flow controllers. Such controllers are used to control the flow of shot to the shot peening gun. One common type of mass flow controller for use with shot made from magnetic material has an electromagnet which is pulsed in order to allow passage of a metered amount of shot into a shot peening gun. This common type of mass flow controller uses internal feedback to stabilize the mass flow rate (i.e., the amount of shot metered in a given time). A control may be used to set the mass flow rate to a desired value. A display is often used to indicate the flow rate.

As part of a mass flow controller, or as a separate component, prior shot peening systems have included various shot flow meters which provide an indication of the flow rate of the shot. The shot flow meter might be a magnetic densitometer, an example of which is the Model 260 Shot Flow Meter manufactured by Electronics Incorporated of Mishawaki, Ind.

The sensor of the magnetic densitometer, as typified by the Model 260, is a wire coil wound around a tube through which the shot travels. Basically, the device measures the amount of shot under the coil at a given time by sensing the inductance of the coil. In the length of time it takes a particle of shot to traverse the length of the coil, the shot in the coil is fully replaced by new shot.

Therefore, if

L=coil length (inches)

T=time for shot to pass through coil (sec.)

v=shot velocity (in./sec.)

m=amount of shot inside the coil (lbs.) and dm/dt=R=shot mass flow rate, the mass flow rate of shot through the coil is:

$$R=m/T \text{ (lbs./sec.)} \quad (1)$$

and $$v=L/T \text{ (in./sec.)} \quad (2)$$

such that $$R=mv/L \text{ (lbs./sec.)} \quad (3)$$

In order to solve for the mass flow rate R, the coil of the magnetic densitometer of Model 260 is installed in the shot feed line vertically beneath the shot flow control valve. From ballistics, the average velocity v of the freely falling shot in the coil is a known constant.

Since the densitometer measures m and the values v and L are known constants, the signal processing section of the flow meter performs equation 3 and develops a signal representative of the mass flow rate R.

Although the mass flow rate is useful information, it is insufficient by itself to give an indication of the quality of the shot peening applied to a particular surface.

The intensity of the shot peening process depends on the extent to which the workpiece surface is upset by impact of the shot stream. This upset depends to a large extent on the kinetic energy of the shot impact in the area over which it is absorbed. The shot particle energy is one-half of the particle mass times the particle velocity squared. It is clear that the shot velocity is an important factor in surface upset.

Although some measurement techniques have been used in conjunction with the shot peening process, most such prior techniques have been inadequate to conveniently and inexpensively provide an indication of the quality of the shot peening technique. The general absence of simple and inexpensive techniques to measure the quality of shot peening inhibits one's confidence that consistent shot peening results can be obtained.

A further problem of some shot peening systems is the inability to detect a malfunction such as a clogged nozzle or an air leak and take corrective action. This inability to detect malfunctions may result in workpieces going through the process without being peened.

OBJECTS AND SUMMARY OF THE INVENTION

A primary object of the present invention is to provide a new and improved shot peening system and process.

A more specific object of the present invention is to provide for the quantifying of shot peening so as to facilitate consistent results.

A further object of the present invention is to provide for the detection of malfunctions which may otherwise interfere with proper shot peening.

Yet another object of the present invention is to provide an arrangement which may be readily fit onto pre-existing shot peening guns for quantifying a shot peening process.

A still further object of the present invention is to provide a shot peening system and method for accurately measuring the average shot velocity.

The above and other objects of the present invention which will become more apparent as the description proceeds are realized by a shot peening system including a shot peening gun having a nozzle with an outlet. A coil is adjacent to the outlet and is connected to a sensing circuit operable to sense the amount of ferromagnetic shot within the coil by sensing the inductance of the coil. The sensing circuit generates an amount signal representative of the amount. A calculation circuit or means receives the amount signal and generates a velocity signal representative of the average velocity of shot leaving the gun. In one embodiment, the coil is wound around the nozzle. In a second embodiment, the coil is wound around a core of non-ferromagnetic material which is secured to the nozzle by a clamp. A mass flow sensor generates a flow rate signal which is fed to the calculation means. The velocity signal generated by the calculation means depends on the flow rate signal and the amount signal. The calculation means includes a multiplier for receiving and multiplying the flow rate signal and a length signal representative of the length of the coil and a divider receiving an output of the multiplier for dividing the multiplier output by the amount signal. The velocity signal is generated as the output of the divider. The system further includes a velocity display connected to receive the velocity signal. The system may further include means for generating a NO GO signal upon the sensing circuit detecting improper operation of the system. An alarm sounds and shot peening is halted in response to the NO GO signal.

The method of shot peening of the present invention includes supplying shot to a gun for shot peening, operating the gun to expel shot from a nozzle of a gun, sensing the amount of shot within a volume adjacent a nozzle outlet of the gun, generating an amount signal based on the sensed amount, supplying the amount signal to a calculation means, and generating, by operations of the calculation means, a velocity signal representative of the average velocity of shot from the nozzle outlet.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
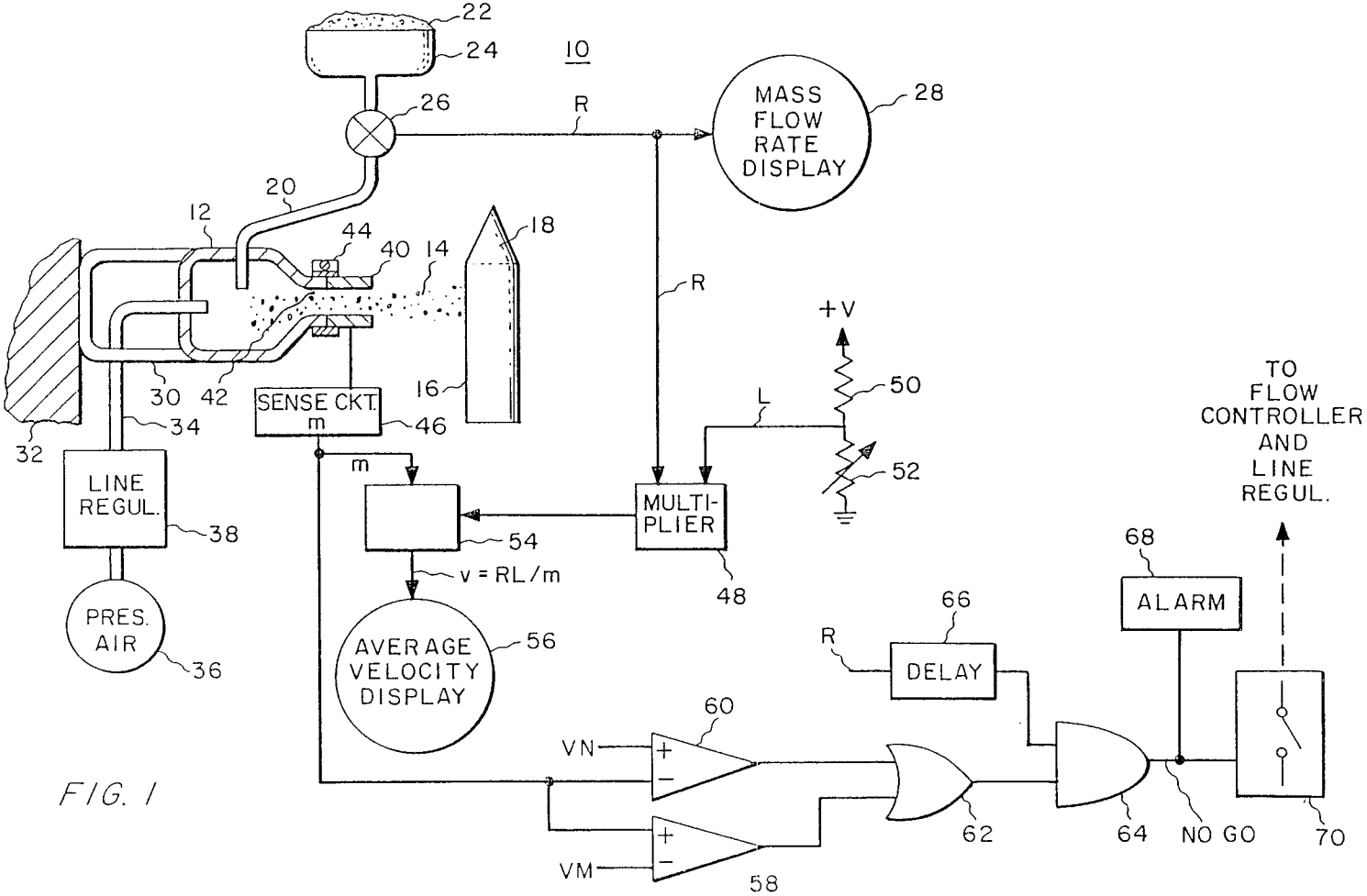
FIG. 1 shows a schematic of the shot peening system of the present invention in conjunction with a side cross section view of a shot peening gun having a first embodiment sensor.

FIG. 1 shows the system 10 according to the present invention. In particular, the system 10 includes a shot peening gun 12 operable to supply shot 14 to a surface 16 of workpiece 18. The shot peening gun 12, which is shown in cross section, is a gravity type of shot peening gun, although the present invention may alternatively use other known types of shot peening guns such as a suction lift gun or a pressure pot gun.

The gun 12 is supplied shot by a shot feed line 20 which carries shot 22 from a hopper 24. The shot is supplied to the feed line 20 by way of a flow controller 26. The flow controller 26 may be a common type of flow controller using an electromagnet to dispense metered amounts of metallic shot, although other types of flow controllers might be used. The flow controller 26 supplies a mass flow rate signal R as shown. The mass flow rate signal R may be generated by having a magnetic densitometer (not separately shown) built into the flow controller 26 in known fashion. More specifically, the mass flow rate signal R may be generated from the inductance of a coil such as used in the Model 260 Electronics Inc. shot flow meter and which applies equation 3 discussed in detail above. The rate signal R is supplied to a mass flow rate display 28.

The gun 12 is mounted upon a bracket 30 which in turn is attached to support 32. An air feed line 34 supplies pressurized air from pressurized air source 36 by way of line regulator 38.

The components of FIG. 1 which are discussed above are relatively standard components. The discussion which follows will emphasize the additional components of the system 10 which are used to generate a signal representative of the average velocity of the shot 14 and which are used to generate a "NO GO" signal upon improper operation of the system.

A sensor 40 is secured adjacent the nozzle outlet 42 of gun 12 by ring clamp 44. The detailed structure of sensor 40 will be discussed in detail below in connection with FIG. 2, but it should be noted here that the sensor 40 includes a coil (not shown in FIG. 1) which is electrically connected to a sensing circuit 46. The coil sensor 40 and the sensing circuit 46 together operate as a magnetic densitometer in known fashion. More specifically, the sensing circuit 46 internally generates a signal based upon the inductance of the coil within sensor 40. As the inductance of the coil within sensor 40 depends upon the amount of ferromagnetic shot within the coil, the sensing circuit 46 generates an output m representative of the mass of ferromagnetic shot within the confines of the coil. As the details of the calculations used to generate a mass signal from a coil in a magnetic densitometer are relatively well known, they need not be discussed in detail.

The flow rate signal R from the mass flow controller 26 (which may incorporate a shot flow meter such as the Electronics, Inc. Model 260) is supplied to a multiplier 48. The multiplier 48 multiplies the mass flow rate signal R with a signal L representative of the length of the coil within sensor 40. In particular, the signal L may be generated from a voltage divider having resistor 50 and variable resistor 52. The variable resistor 52 would of course be adjusted and set to a position such that the signal L accurately represented the length (e.g., axial length) of the coil within sensor 40. The output of multiplier 48 is a signal representative of the product of the mass flow rate R and the length L. This product is supplied to a divider 54. The divider 54 generates an output which is the product of multiplier 48 divided by the signal m representative of the mass within the coil of sensor 40. This output of divider 54 is representative of the average velocity of the shot 14 which is ejected from the gun 12. This average velocity signal is supplied to an average velocity display 56. Instead of using multiplier 48, R could be scaled by an amplifier (not shown) having L as its gain or the display 56 could simply be calibrated to "multiply" by L by scaling its results.

Some mathematics may be helpful in explaining why the output of divider 54 does correspond to the average velocity of the shot. If we rearrange equation 3 from above, we have:

$$v = RL/m \tag{4}$$

As the mass flow controller 26 has generated the flow rate R, equation 4 can then be used to determine the velocity. Unlike the situation where the shot is passing through mass flow controller 26, the shot 14 ejected from gun 12 does not have a known constant average velocity. Instead, the velocity depends on factors such as upon the air pressure supplied by conduit 34. Given that the rate R is known from mass flow controller 26, the length L is a known constant, and the mass m is calculated by sensing circuit 46 or any other of numerous well known magnetic densitometer arrangements, the divider 54 and multiplier 48 then calculate the average velocity of the shot 14 leaving the gun 12 by executing equation 4 above.

If the amount of shot within the coil corresponding to sensor 40 is too high or too low, this may be indicative of improper operation such as a clog at the nozzle or somewhere else in the shot feed line. Alternatively, it might be indicative of a break in the shot feed line 20. An arrangement for notifying a machine operator of the malfunction will now be discussed.

The signal m is supplied to comparators 58 and 60 which respectively compare the signal with a maximum voltage VM and a minimum voltage VN. If the signal m, which is representative of the mass of shot within the coil of sensor 40 is below the minimum or above the maximum, the corresponding comparator 58 or 60 will go high and in turn generate a high level at the output of OR gate 62. The output of gate 62 is supplied to AND gate 64, which gate also receives the mass flow rate signal R by way of delay 66. The delay 66 is simply provided so that, upon start up of the system, the arrangement will not erroneously detect improper operation due to the time lag from turn on of the mass flow controller 26 to the actual ejection of shot 14 from gun 12. Depending on the range of values for R, R could be used directly as an input to delay 66 as shown or could be used to close a semiconductor switch (not shown) which supplies an appropriate level input to delay 66 for registering a high at the upper input of gate 64.

The output of gate 64 is a NO GO signal which is supplied to alarm 68. The sounding of the alarm 68 may notify a machine operator that the shot peening gun is not operating properly. Additionally, the NO GO signal may be provided to a power switch 70 which can be connected to the mass flow controller 26 and the line regulator 38 so as to preferably cut off the power supply to both of those two components. In other words, the opening of switch 70 will stop the flow of shot and pressurized air to the gun 12. Thus, upon an improper operating condition corresponding to the mass of shot within the coil of sensor 40 being too high or too low, the alarm 68 will alert the operator and the switch 70 will halt the shot peening operation until corrections or adjustments may be made.

The NO GO circuitry could alternately or additionally be arranged to generate a NO GO signal upon the velocity signal assuming a value which is so high or so low as to indicate improper operation.

Figure 2:
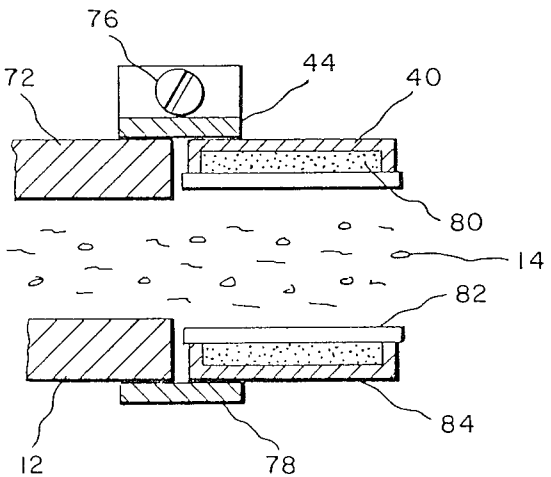
FIG. 2 shows an enlarged side cross section view of the first embodiment sensor according to the present invention.

Turning now to FIG. 2, the details of the structure of sensor 40 will be discussed. The view of FIG. 2 shows a cross section of the sensor 40 at the tip of nozzle 72 of the gun 12. The sensor 40 may be clamped on to the end of the nozzle 72 by a ring clamp 44 having a screw 76 to tighten it. The ring clamp 44 may be of the same general type as a commonly used hose clamp for securing a garden hose to an inside connector. As such, it includes a ring 78 which is tightened by tightening the screw 76. The sensor 40 is cylindrical and of the same outside diameter as the nozzle 72 such that the hose clamp 44 may mate to the outside diameter of nozzle 72 and the outside diameter of sensor 40. The sensor 40 has a coil 80 which is disposed on a non-ferromagnetic core 82. A steel flux concentrator 84 extends around three (3) sides of the cross section of the coil 80. The coil 80, core 82, and steel flux concentrator 84 each extend cylindrically around the outlet at the tip of nozzle 72. The preferred material for the core 82 is polyethylene so as to protect the coil 80 from the relatively hostile environment corresponding to the shot 14. In addition to keeping out foreign material, the ring-like steel flux concentrator 84 concentrates the magnetic field set up by coil 80 to a zone within the coil 80.

The arrangement for the sensor 40 of FIG. 2 makes the present system 10 applicable to a preexisting shot peening gun 12 (only partially shown in FIG. 2). The sensor 40 may easily be clamped by the hose clamp 44 to the end of a preexisting shot peening gun 12. Alternatively, a bracket (not shown) or series of brackets (not shown) could be used to mount the sensor 40 to the tip of nozzle end of the gun 12.

Figure 3:
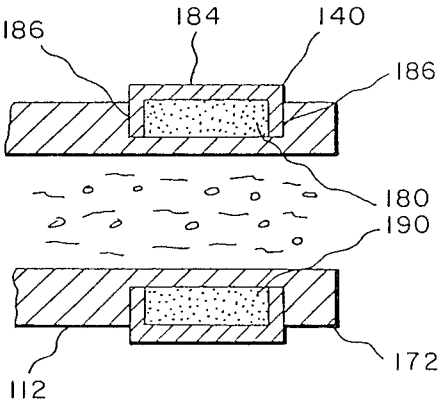
FIG. 3 shows a side cross section view of a second embodiment sensor according to the present invention.

FIG. 3 shows an alternate arrangement in which a sensor 140 is built into the shot peening gun 112. It will be noted that the components of the embodiment of FIG. 3 have the same last two digits as the corresponding component, if any, of the embodiment or arrangement of FIG. 2. The sensor 140 is built into the gun 112 adjacent the nozzle 172. Specifically, the nozzle 172 has a cylindrical depression 190 in which the coil 180 is seated. Additionally, the cylindrical steel flux concentrator 184 has side surfaces 186 extending downward into the cylindrical depression 180. The sensor 140 operates as a sensing coil for a magnetic densitometer in the same fashion as the sensor 40. Since polyethylene is very abrasion resistant, it may be used as the material for the nozzle 172 of gun 112.

An alternate arrangement broadly contemplated by the present invention would use a nozzle coil sensor such as 40 of FIGS. 1 and 2 or 140 of FIG. 3 to provide magnetic densitometer information in combination with a reaction force sensor. Such a reaction force sensor (not shown) would be disposed between the bracket 30 and support 32 in the manner shown and described in the present inventor's prior patent application entitled "SHOT PEENING SYSTEM AND METHOD WITH VELOCITY SENSING" filed Dec. 28, 1987, Ser. No. 138,004, assigned to the assignee of the present application, and hereby incorporated by reference. The contemplated alternative to the arrangement of FIG. 1 would include a sensor such as 40 adjacent the nozzle of the gun and the reaction force sensor such as disclosed in the incorporated by reference application. The alternative would not require the generation of the rate signal R from the mass flow controller such as 26 of FIG. 1. Instead, the force sensor would be used to sense the force due to the expulsion of shot from the gun 12 by way of the technique described in the present inventor's prior application.

The shot force F satisfies the equation:

$$v=F/R \tag{5}$$

Recalling equation 4 above and since this alternate embodiment does not use the mass flow controller 26 to provide the rate signal R for the equation, equations 4 and 5 are two (2) independent equations having the two (2) unknowns of the average shot velocity v and the flow rate R. Equating the right sides of equations 4 and 5 and solving for R indicates that the unknown flow rate may be calculated as follows:

$$R=(Fm/L)^{\frac{1}{2}} \tag{6}$$

The equations then may be solved for v as follows:

$$v=(FL/m)^{\frac{1}{2}} \tag{7}$$

By using a magnetic densitometer coil arrangement at the nozzle of the gun in combination with a reaction force sensor as in this alternate embodiment, very accurate results may be obtained. It will be appreciated that this alternate arrangement would provide the force signal in similar fashion to that described in the incorporated by reference prior patent application and the signal m corresponding to the mass of shot within the coil of the sensor adjacent the nozzle would be provided. Those two (2) signals, together with a constant L representative of the length of the coil, would simply be used by a calculation circuit to generate the values of the mass flow rate R and the velocity signal v.

Obvious implementation requirements may cause one to include a manifold between the air supply hose and the gun itself and/or a manifold between the shot supply hose and the gun itself in order to prevent extraneous hose forces from entering the gun when the gun is moved.

Although various specific embodiments and arrangements have been disclosed herein, it is to be understood that these are for illustrative purposes only. Various modifications and adaptations will be apparent to those of skill in the art. Accordingly, reference should be made to the claims appended hereto in order to determine the full scope of the present invention.

What is claimed is:

1. A shot peening system comprising:

a gun for shot peening, said gun having a nozzle with an outlet;

a first sensor in contact with said nozzle adjacent said nozzle outlet, said first sensor including a coil having an inductance which varies according to the amount of shot passing through said nozzle outlet;

first sensing circuit means connected to said coil for sensing the inductance of said coil and generating an amount signal representative of said amount of shot passing through said nozzle outlet;

a second sensor responsive to the amount of shot supplied to said gun;

second sensing circuit means connected to said second sensor for generating a time-dependent signal corresponding to the amount of shot supplied to said gun during a unit period of time; and calculation means for receiving as inputs said amount signal and said time-dependent signal and generating therefrom a velocity signal representative of the average velocity of shot leaving the gun.

2. The shot peening system of claim 1 wherein said coil is wound around said nozzle.

3. The shot peening system of claim 1 wherein said coil is wound around a core of non-ferromagnetic material in contact with said nozzle adjacent said nozzle outlet.

4. The shot peening system of claim 3 wherein said coil is secured to said nozzle by a clamp.

5. The shot peening system of claim 1 wherein said second sensor comprises a mass flow sensor for generating said time-dependent signal as a function of mass flow rate.

6. The shot peening system of claim 5 wherein said calculation means generates the velocity signal by calculating:

$$v=RL/m$$

where v=average shot velocity, R=mass flow rate, L=axial length of coil and m=mass of shot in said coil.

7. The shot peening system of claim 5 further comprising a velocity display connected to receive said velocity signal.

8. The shot peening system of claim 7 wherein said coil is wound around said nozzle.

9. The shot peening system of claim 7 wherein said coil is wound around a core of non-ferromagnetic material in contact with said nozzle adjacent said nozzle outlet.

10. The shot peening system of claim 9 wherein said coil is secured to said nozzle by a clamp.

11. The shot peening system of claim 6 further comprising means for generating a NO GO signal when said first sensing circuit means detects a condition indicative of improper operation of said gun.

12. The shot peening system of claim 11 further comprising an alarm which sounds in response to said NO GO signal.

13. The shot peening system of claim 11 further comprising means for halting shot peening upon occurrence of a NO GO signal.

14. A method of shot peening comprising the steps of:

supplying shot to a gun;

generating a time-dependent signal as a function of the amount of shot supplied to said gun during a unit period of time;

operating said gun to expel shot from the nozzle outlet of said gun;

sensing the amount of shot within a volume immediately adjacent said nozzle outlet;

generating an amount signal based on said sensed amount of shot;

supplying said amount signal and said time-dependent signal to a calculation means; and generating, by operation of said calculation means, a velocity signal representative of the average velocity of shot leaving the gun through said nozzle outlet.

15. The method of claim 14 wherein the shot is sensed by a coil which extends around said volume.

16. The method of claim 15 wherein said time-dependent signal is provided by generating a flow rate signal dependent on the flow of shot to said gun.

17. The method of claim 16 wherein the generation of said velocity signal includes the calculation:

$$v=RL/m$$

where v=average shot velocity, R=mass flow rate, L=axial length of coil and m=mass of shot in said coil.

18. The method of claim 14 wherein said volume is located within the nozzle of said gun.

19. The method of claim 15 wherein said volume is located just outside said nozzle outlet.

20. The method of claim 14 further comprising the steps of displaying the average velocity of shot from the nozzle outlet, generating a NO GO signal when the sensed information indicates improper operation of the gun, and halting shot peening in response to said NO GO signal.

* * * * *